United States Patent [19]

Stilwell et al.

[11] Patent Number: 5,047,746

[45] Date of Patent: Sep. 10, 1991

[54] POTENTIOMETER WIPER ASSEMBLY

[75] Inventors: Stephen R. Stilwell, Riverside; Ronald L. Froebe, Rubidoux, both of Calif.

[73] Assignee: Bourns, Inc., Riverside, Calif.

[21] Appl. No.: 529,981

[22] Filed: May 24, 1990

[51] Int. Cl.[5] ..... H01C 10/32

[52] U.S. Cl. ..... 338/162; 338/167; 338/168; 338/170; 338/171

[58] Field of Search ..... 338/170, 167, 168, 171, 338/160, 162

[56] References Cited

U.S. PATENT DOCUMENTS

| | | | |
|---|---|---|---|
| 3,704,436 | 11/1972 | Froebe et al. | 338/202 |
| 3,755,892 | 9/1973 | Dieterich | 338/162 X |
| •4,186,483 | 2/1980 | Laube et al. | 29/630 B |
| 4,427,966 | 1/1984 | Gratzinger et al. | 338/162 |
| 4,679,024 | 7/1987 | Kittleson | 338/160 |
| 4,810,994 | 3/1989 | Froebe et al. | 338/202 |

*Primary Examiner*—Marvin M. Lateef
*Attorney, Agent, or Firm*—Howard J. Klein

[57] ABSTRACT

A wiper assembly for a potentiometer, particularly a rotary potentiometer having a rotor for carrying the wiper assembly along a resistive element, includes a metal plate attached to the rotor. A strip of metal formed integrally with the plate is bent back over itself out of the plane of the plate to form a cantilevered spring arm having a free end. Attached to the free end is an array of resilient, conductive wires arranged in a parallel, side-by-side relationship, each of the wires forming a resilient, cantilevered wiper finger. The spring arm and the array of wire wiper fingers attached to it form a hybrid wiper arm assembly. Preferably, the plate includes a first such hybrid wiper arm assembly arranged to function as a wiper for the resistive element in the potentiometer, and a second such wiper arm assembly arranged to function as a wiper for a conductive collector element in the potentiometer.

20 Claims, 1 Drawing Sheet

POTENTIOMETER WIPER ASSEMBLY

BACKGROUND OF THE INVENTION

This invention relates to the field of potentiometers. More specifically, it relates to a wiper assembly for a potentiometer, of the type having a thick film or thin film resistive element.

Miniature rotary potentiometers typically employ a resistive element that is formed on a substrate in a substantially annular configuration, and concentrically surrounding a central conductive collector. Electrical contact is established between the collector and a selectable position on the resistive element by means of a contact mounted on a rotor. A common type of contact is that which is known as a "multi-wire wiper", comprising a multiplicity of individual wires, cantilever-mounted on the rotor in an abutting, side-by-side relationship, to form a multi-wire spring contact that brushes against, or "wipes", the resistive element as the rotor is turned. Examples of this type of contact are disclosed in the following U.S. Patents, all commonly assigned to the assignee of the present application: U.S. Pat. No. 3,704,436 to Froebe et al.; U.S. Pat. No. 4,186,483 to Laube et al.; U.S. Pat. No. 4,427,966 to Gratzinger et al.; and U.S. Pat. No. 4,810,994 to Froebe et al.

Multi-wire contacts exhibit low contact resistance and low contact resistance variation (CRV). Nevertheless, this type of contact still poses some problems, such as splaying or fanning of the individual wires, fragility and susceptibility to damage during handling and use, and side-to-side movement of the fingers ("chatter") while traveling over the resistive element. These problems have been ameliorated, but not altogether eliminated, by the use of bracing fingers, or "outriggers", on either side of the wiper element, which increases the manufacturing cost, while using some of the limited space available in such devices.

Another approach to the aforementioned problems is disclosed and claimed in U.S. Pat. No. 4,810,994 to Froebe et al. This patent relates to the use of a multi-wire wiper that is shaped as annular spiral. While excellent results have been obtained with the spiral-shaped contact assembly, improved performance is still desired, and further reductions in the size of the contact assembly, and the cost of manufacturing it, have been sought.

SUMMARY OF THE INVENTION

Broadly, the present invention is a wiper arm assembly for a rotary potentiometer, comprising a strip of conductive metal, bent over itself to form a cantilevered spring arm, and having a free end to which is attached a multiplicity of conductive wires, arranged in a parallel, side-by-side relationship, extending beyond the free end of the spring arm to form an array of resilient, cantilevered wiper fingers.

More specifically, in a preferred embodiment of the invention, the strip is formed as an integral extension of a metal plate that is mounted to the underside of a rotor in a rotary potentiometer. The free end of the strip is bent over itself, out of the plane of the plate, thus forming a resilient, cantilevered spring arm. An array of parallel conductive wires is attached to the free end of the strip (as by welding or soldering), so as to extend beyond the free end, each of the wires thereby forming a resilient, cantilevered wiper finger, and the wires collectively forming a resilient, cantilevered wiper having independently deflecting tips.

A wiper arm assembly constructed in accordance with the present invention offers the advantages of prior art multi-wire wiper assemblies (such as low CRV, for example), while also providing additional advantages, not previously obtained with such wiper assemblies. For example, the wiper fingers in the present invention, being shorter than those in prior art multi-wire wipers, are less prone to damage during handling and use, and are less prone to splaying and fanning while tracking the resistive element, thereby obviating the need for bracing fingers or outriggers. Also, the shorter fingers substantially lower the cost of the assembly by reducing the mass of precious metal alloys used in the fingers, the use of which offers many well-known advantages in certain applications. In addition, the present invention offers greater design flexibility than the prior art, in several respects: (1) The distribution of stress in the wiper arm assembly can be optimized through selection of strip and wire materials and dimensions. (2) The orientations of the separate wiper arm assemblies for the resistive element and the collector can be separately selected for optimum usage of space on the rotor, thereby allowing reductions in size of the potentiometer. (3) The the wiper fingers can be made with a lower spring rate to improve wiper and resistive element wear. (4) The wiper arm assembly exhibits greatly reduced stress, as compared to conventional multi-wire wipers, thereby further contributing to improved wiper wear.

These and other advantages of the present invention will be better understood from the detailed description that follows.

DETAILED DESCRIPTION OF THE INVENTION

Figure 1:
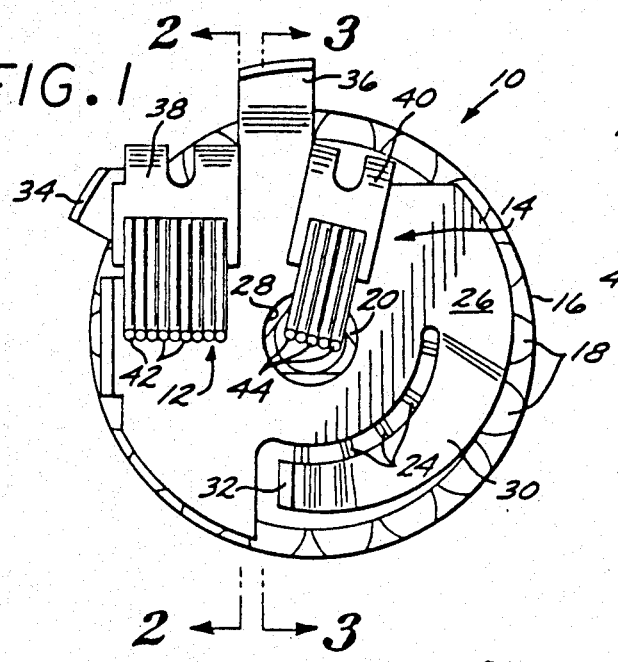
FIG. 1 is a bottom plan view of a rotary potentiometer rotor incorporating multi-wire wiper arm assemblies in accordance with the present invention.
Figure 2:
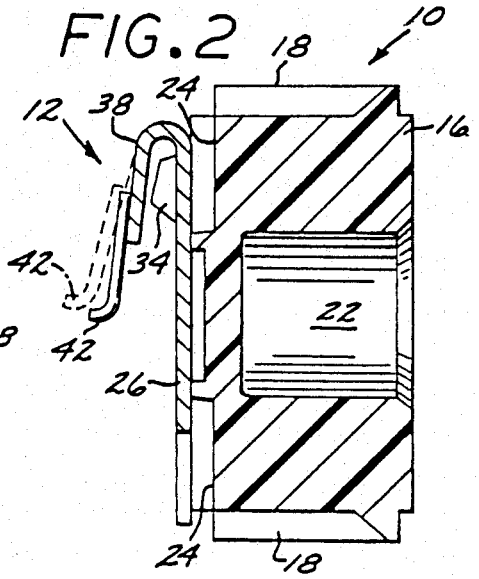
FIG. 2 is a cross-sectional view taken along line 2—2 of FIG. 1.
Figure 3:
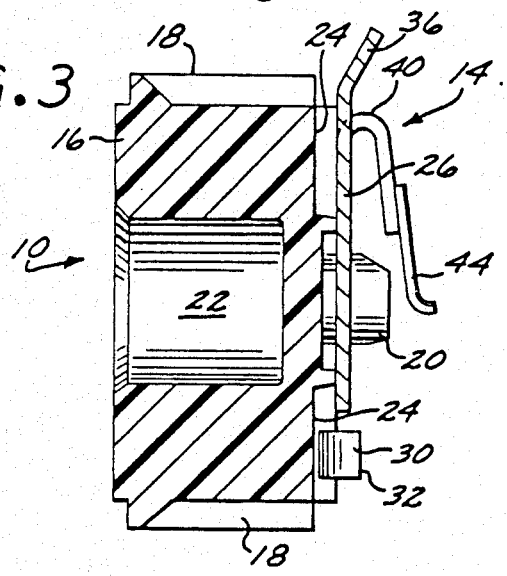
FIG. 3 is a cross-sectional view taken along line 3—3 of FIG. 1.

Referring now to the drawings, FIGS. 1, 2, and 3 illustrate a potentiometer contact/rotor assembly 10 incorporating first and second wiper arm assemblies 12 and 14, respectively, constructed in accordance with a preferred embodiment of the present invention. The contact/rotor assembly comprises a drum-shaped carrier or rotor 16 formed with a plurality of spur gear teeth 18 around its peripheral edge. The carrier or rotor 16 may be made of molded, electrically non-conductive thermoplastic, such as nylon or polyetheretherketone (PEEK). One surface of the rotor 16, which may be defined as the bottom surface, is provided with a central axial post 20, while the opposite, or top, surface, is formed with a central cavity 22. Extending radially outwardly from the post 20 are a plurality of equidistantly-spaced grooves 24, preferably of "V"-shaped cross-section.

A conductive metal base plate 26, having a central aperture 28, is press-fit onto the post 20. The base plate 26 is preferably made from a non-precious metal alloy with good spring quality. For example, a copper-nickel-tin alloy (approximately 7.0%–8.0% nickel, 4.5%–5.5% tin, the balance copper) marketed under the trademark "SPINODAL" by Ametek, Inc., of Wallingford, Conn. is used in the preferred embodiment of the invention. Other alloys that have suitable conductive qualities and spring characteristics may also be used, such as beryllium-copper and nickel-silver alloys. The fit between the edge of the aperture 28 and the post 20 is a loose friction fit, that allows slippage between the plate 26 and the rotor 16, as will be discussed below.

The plate 26 is provided with a resilient, circumferentially-directed detent finger 30, having a free end 32 that is directed upwardly to releasably engage the radial grooves 24 formed in the bottom surface of the rotor 16. Also provided are first and second mechanical stops, 34 and 36, respectively, that extend outwardly from the generally circular peripheral edge of the plate 26. The purposes of the detent finger 30 and the mechanical stops 34 and 36 will be explained below.

The plate 26 is also formed with a pair of strips that extend outwardly from the peripheral edge of the plate, and then are bent back over themselves, out of the plane of the plate, to form first and second cantilevered spring arms 38 and 40, respectively. The first spring arm 38 is bent in a direction that is substantially parallel to the diameter of the plate 26, that is, its longitudinal dimension is along a non-diametric chord of a circle that is generally defined by the peripheral edge of the rotor 16. The second spring arm 40, which is somewhat narrower than the first spring arm 38, is bent in a direction that is substantially along a radius of the aforesaid circle, that is, its longitudinal dimension forms a radius of the circle.

A first array of resilient conductive wire fingers 42 is attached to the first spring arm 38 in parallel, side-by-side relationship, to form the first wiper arm assembly 12. The wire fingers 42 are preferably made of a precious metal alloy, such as the alloys marketed under the trademark "PALINEY" by J. M. Ney Co., of Bloomfield, Conn. In a preferred embodiment of the present invention, the particular alloy called "PALINEY 7", an alloy of palladium, platinum, gold and silver, is used. The wire fingers 42 may be attached to the spring arm 38 by any suitable means, such as welding or soldering. The free ends of the wire fingers are preferably bent or curved in a suitable configuration for functioning as a wiper against a resistive element, as will be described below.

A second array of wire fingers 44 is similarly attached to the end of the second spring arm 40 to form the second wiper assembly arm 14. The fingers 44 in the second array are typically formed of the same alloy as the fingers 42 in the first array, and are similarly bent or curved at their free ends for functioning as a wiper against a conductive collector, as will be described below.

Figure 4:
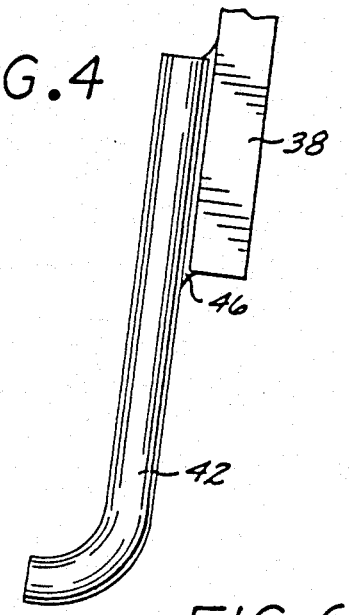
FIG. 4 is a detailed, side elevational view of the multi-wire wiper portion of the multi-wire wiper arm assembly constructed in/accordance with the present invention.

FIG. 4 shows a detailed side elevational view of the first wiper arm assembly 12, with the wire fingers 42 (only one of which is visible in this view) attached to the spring arm 38 by a layer of solder 46, so as to extend beyond the free end of the contact spring. The second wiper arm assembly 14 would appear the same if shown in the same view.

The plate 26, along with the first and second wiper arm assemblies 12 and 14, may collectively be defined as a wiper assembly or a contact assembly.

Figure 5:
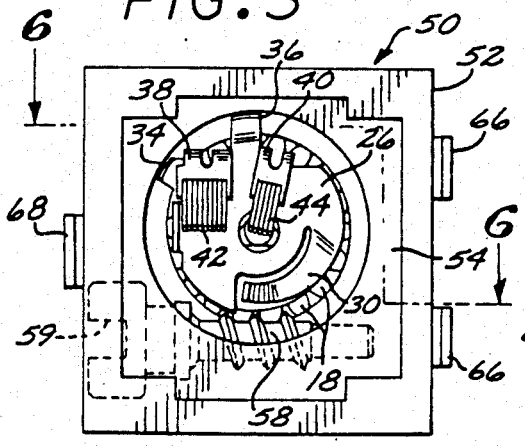
FIG. 5 is a plan view of the rotor, similar to the view of FIG. 1, but showing the rotor contained in a worm-drive potentiometer.
Figure 6:
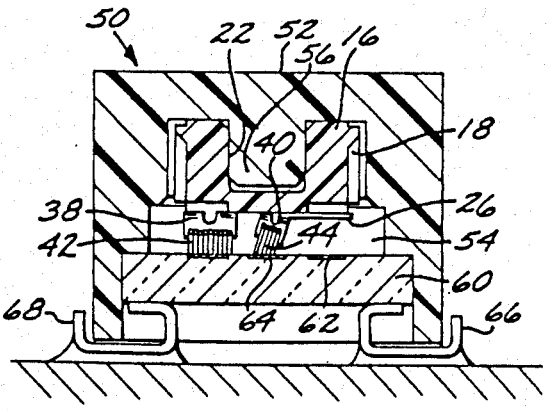
FIG. 6 is a cross-sectional view taken along line 6—6 of FIG. 5.

FIGS. 5 and 6 illustrate the contact/rotor assembly 10 installed in a multi-turn, worm-drive potentiometer 50. The potentiometer 50 comprises a housing 52 with a central cavity 54 in which the contact/rotor assembly 10 is installed. The interior of the cavity 54 is provided with a central hub 56 depending from the interior top wall surface of the cavity. The hub 56 is received in the central cavity 22 in the top surface of the rotor 16, whereby the rotor 16 is rotatable on the hub 56.

The housing 52 has a lateral bore, extending from one side of the housing into the interior thereof, in which is installed a worm gear 58. The worm gear 58 is situated so as to be operationally engageable with the gear teeth 18 of the rotor 16. A slotted head 59 is provided on the worm gear 58, to allow the worm gear to be rotated by a screwdriver or other tool (not shown), thereby rotating the contact/rotor assembly 10. In a potentiometer employing the preferred embodiment of the present invention, the gearing of the worm gear 58 and the rotor gear 16 is selected so that approximately twelve turns of the worm gear are needed to rotate the rotor assembly from one limit of travel to the other, although any other suitable gear ratio may be selected.

Referring to FIG. 6, a ceramic substrate 60 is installed in the housing 52. The upper surface of the substrate 60 carries an arcuate resistive element 62, typically formed of a cermet ink, as is well-known in the art. The resistive element 62 used with the preferred embodiment of the present invention subtends an arc of approximately 240 degrees. Also carried on the substrate 60 is a centrally-located conductive pad or collector 64. Conductive elements (not shown) are formed on the substrate surface, as is well-known in the art, to provide electrical connections between the resistive element 62 and a pair of resistive element terminals 66 and between the collector 64 and a collector terminal 68. The terminals 66 and 68 are shown in the drawings configured as surface mount leads.

As shown in FIG. 6, the first wiper arm assembly 12 engages the resistive element 62, so as to establish electrical contact between the first array of fingers 42 and the resistive element, while the second wiper arm assembly similarly engages the collector 64 to establish electrical contact between the second array of fingers 44 and the collector.

The ends of the resistive element 62 define the limits of rotational travel for the first wiper arm assembly 12. It is common practice to provide means in the housing and on the contact/rotor assembly to prevent rotation of the wiper arm assembly beyond these limits of travel. In the illustrated embodiment, the overtravel prevention means comprises the first and second stop fingers 34 and 36, respectively, which abut against first and second stop elements (not shown), suitably located within the housing cavity, when the first wiper arm assembly 12 reaches the first and second limits of travel, respectively.

To prevent damage to the contact/rotor assembly 10 if the worm gear 58 is turned when the wiper arm assembly 12 is at its limits of travel, as discussed above, a clutch mechanism is provided. In the potentiometer embodiment illustrated in the drawings, the clutch mechanism comprises the detent finger 30 and the radial grooves 24 on the underside of the rotor 16. In operation, the free end 32 of the detent finger 30 rides in one of the grooves 24 during normal rotation of the contact-/rotor assembly, thereby causing the plate 26 and the rotor 16 to rotate together. When one of the stop fingers 34 or 36 abuts against its respective stop element at one of the limits of travel of the wiper arm assembly 12, the plate 26 (which is integral with the stop fingers 34 and 36) is stopped from further rotation. As mentioned above, there is slippage between the plate 26 and the post 20 of the 16 gear on which the plate 26 is carried. This slippage allows the rotor 16 to continue turning while the plate 26 is stopped, with the free end 32 of the resilient detent finger 30 popping into and out of successive grooves 24 on the underside of the rotor 16. When the rotational direction of the rotor assembly is reversed, the free end 32 of the detent finger 30 reengages one of the grooves to cause the rotor 16 and the plate 26 to resume turning together.

In a specific example of a wiper arm assembly constructed in accordance with the present invention, an array of 2.5 mil diameter PALINEY 7 wire fingers was attached to a spring arm formed of a 3 mil thick strip of SPINODAL alloy. The wire array was approximately 30 mils in length, with about 20 mils of that length extending beyond the free end of the spring arm, thereby providing a wire/strip overlap of approximately 10 mils. A stress analysis was performed on this structure, and the results were compared to a similar stress analysis performed on a conventional multi-wire wiper, also formed of 2.5 mil diameter PALINEY 7 wire. It was observed that the hybrid wiper arm assembly structure of the present invention exhibited at least 50 per cent to 60 per cent less stress, for a given amount of deflection, along the length of the wiper arm assembly that included the metal strip, as compared to the analogous portion of the conventional multi-wire wiper. This dramatic decrease in stress would result in much better control of contact forces for wiper arm assemblies constructed in accordance with the present invention, as compared to conventional multi-wire wipers, with an attendant improvement in the performance and durability of the potentiometer.

From the above description, the advantages of the present invention will easily be appreciated. Specifically, by using wiper arm assemblies in which contact with the resistive element is established by a multi-wire wiper, the low CRV characteristics associated with such wipers are realized. Nevertheless, the present invention, by "grafting" short wire fingers onto a spring arm strip, substantially reduces the tendency of the fingers to splay or fan out during use, while also minimizing the likelihood of damage to the fingers. The use of such short fingers also substantially reduces the cost of fabricating such fingers from precious metal alloys.

In addition, as noted above, the wire fingers and the spring arms on which they are mounted are advantageously of two different materials, selected for (a) optimizing the distribution of stress within the wiper arm assembly; (b) raising the deflection -to-yield point of the assembly; and (c) reducing the spring rate of the wiper arm assembly, thereby increasing the durability and useful lifetimes of the wiper and the resistive element. Furthermore, the orientation of the wiper fingers with respect to the spring arm can be selected for optimum use of the space within the housing cavity. Moreover, the resistive element wiper arm assembly (the first wiper arm assembly 12 in the above-described embodiment) can be moved further outwardly, in the radial direction (as compared to prior art multi-wire wipers), while maintaining the orientation of the fingers substantially tangential to the direction of rotation. This minimizes the radial vector forces that would tend to push the wiper fingers radially inwardly or outwardly.

It will be appreciated that the length and location of the wire/strip overlap portion on the wiper arm assembly that determine the ratio of wire finger length to overall wiper arm assembly length can be adjusted to optimize the distribution of stress within the wiper arm assembly, the degree of deflection of the assembly, and the spring rate of the assembly. These parameters can also be optimized by material selection (as mentioned above), and by selecting the thickness of the spring arm and the diameter of the wire used to form the fingers.

It will also be appreciated that a number of modifications and variations of the above-described preferred embodiment will suggest themselves to those skilled in the pertinent arts. For example, the materials described above are exemplary only, and other suitable materials may be found to be acceptable. Likewise, alternative orientations of the wiper arm assemblies may be devised that are advantageous for particular applications and types of potentiometers. In addition, the fingers on a wiper arm assembly constructed in accordance with the present invention may be non-uniform in diameter, with thicker fingers (having a higher spring constant) on the radially-inward portion of the wiper arm assembly, to provide higher tracking forces for the fingers traveling the shorter inside tracks than for the fingers traveling the longer outside tracks. This modification may provide more even wear on the resistive element, while also providing a tracking force on the resistive element that is proportional to the current densities therein, which increase in the radially-inward direction.

In still another modification, the metal plate 26 may be configured so that only the resistive element wiper arm assembly 12 is constructed in accordance with the present invention, while the collector wiper is formed as an integral (i.e., non-wire) contact spring.

Furthermore, modification of the present invention for use in connection with rectilinear motion potentiometers should readily suggest itself to those skilled in the pertinent arts.

These and other modifications that may suggest themselves should be considered within the spirit and scope of the present invention, as defined in the claims that follow.

What is claimed is:

1. A wiper assembly for a potentiometer, wherein the potentiometer has a carrier for carrying the wiper assembly along a resistive element, the wiper assembly comprising:

a substantially planar, solid metal plate adapted for attachment to the carrier;

a strip of metal formed integrally with the plate and bent back over itself out of the plane of the plate to form a cantilevered spring arm having a free end;

an array of resilient, conductive wires, each of the wires having first and second ends, the first end of each of the wires being attached to the free end of the spring arm, so that the wires are arranged in a parallel, side-by-side relationship, each of the wires thereby forming a resilient, cantilevered wiper finger, extending beyond the free end of the spring arm.

2. The wiper assembly of claim 1, wherein the carrier has a peripheral edge generally defining a circle, and wherein the spring arm is bent in a direction that is substantially aligned with a non-diametric chord of the circle.

3. The wiper assembly of claim 2, wherein the strip of metal is a first strip of metal that forms a first spring arm, wherein the array of wires is a first array, and wherein the wiper assembly further comprises:

a second strip of metal formed integrally with the plate and bent back over itself out of the plane of the plate to form a second cantilevered spring arm having a free end; and a second array of resilient, conductive wires attached to the free end of the second spring arm in parallel, side-by-side relationship, each of the wires thereby forming a resilient, cantilevered wiper finger, extending beyond the free end of the second spring arm.

4. The wiper assembly of claim 3, wherein the second spring arm is bent in a direction that is substantially aligned along a radius of the circle.

5. The wiper assembly of claim 1, wherein the plate is made of an alloy that is selected from the group consisting of copper-nickel-tin, beryllium-copper, and nickel-silver.

6. The wiper assembly of claim 5, wherein the alloy consists essentially of 7.0 per cent to 8.0 per cent nickel, 4.5 per cent to 5.5 per cent tin, and the balance copper.

7. The wiper assembly of claim 1, wherein the wires in the array are formed of a precious metal alloy.

8. The wiper assembly of claim 7, wherein the precious metal alloy includes palladium, platinum, gold, and silver.

9. The wiper assembly of claim 1, wherein the array of wires is soldered to the free end of the spring arm.

10. The wiper assembly of claim 1, wherein the array of wires is welded to the free end of the spring arm.

11. The wiper assembly of claim 1, wherein the carrier includes a rotor having a central post and a plurality of grooves extending radially from the post, and wherein the metal plate comprises:

a central aperture that receives the post with a fit that allows slippage between the plate and the post; and a resilient, circumferentially-directed detent finger having a free end that is engageable in the grooves;

whereby the engagement between the detent finger free end with any of the grooves causes the plate and the rotor to rotate together until the plate is blocked from further rotation, whereupon the slippage between the plate and the post allows the rotor to continue turning, with the detent finger free end engaging and disengaging successive grooves as the rotor is rotated.

12. A contact/rotor assembly for a rotary potentiometer having a substrate with an arcuate resistive element and a conductive collector element deposited on the surface thereof, the contact/rotor assembly comprising:

a rotor having a central post;

a plate made of a resilient, conductive metal, and having a central aperture receiving the rotor gear post;

a first strip of metal formed integrally with the plate and bent over itself out of the plane of the plate to form a cantilevered resistive element spring arm having a free end;

a first array of resilient, conductive wires attached to the free end of the resistive element spring arm in parallel, side-by-side relationship, each of the wires thereby forming a resilient, cantilevered wiper finger, extending beyond the free end of the resistive element spring arm;

a second strip of metal formed integrally with the plate and bent over itself out of the plane of the plate to form a cantilevered collector element spring arm having a free end;

a second array of resilient, conductive wires attached to the free end of the collector element spring arm in parallel, side-by-side relationship, each of the wires thereby forming a resilient, cantilevered wiper finger, extending beyond the free end of the collector element spring arm; and clutch means, operationally engageable between the rotor and the plate, for causing the rotor and the plate to rotate together until the plate is blocked from further rotation, whereupon the rotor gear is allowed to continue turning without the plate.

13. The contact/rotor assembly of claim 12, wherein the peripheral edge of the rotor generally defines a circle, and wherein the resistive element spring arm is bent in a direction that is substantially aligned with a non-diametric chord of the circle, and the collector element spring arm is bent in a direction that is substantially aligned with a radius of the circle.

14. The contact/rotor assembly of claim 12, wherein the central aperture of the plate receives the rotor post with a fit that allows slippage between the plate and the post, and wherein the clutch means comprises:

a plurality of radial grooves on the rotor, extending from the post; and a resilient detent finger extending from the plate so as to have a free end that is releasably engageable in the grooves;

whereby the engagement between the detent finger free end and any of the grooves causes the plate and the rotor gear to turn together until the plate is blocked from further rotation, whereupon the slippage between the plate and the post allows the rotor to continue turning, with the detent finger free end engaging and disengaging successive grooves as the rotor is rotated.

15. The contact/rotor assembly of claim 14, wherein the detent finger is formed integrally with the plate and is directed circumferentially.

16. The contact/rotor assembly of claim 12, wherein the plate is formed of an alloy that is selected from the group consisting of copper-nickel-tin, beryllium-copper, and nickel-silver.

17. The contact/rotor assembly of claim 16, wherein the plate is formed of an alloy that is predominantly copper, with constituents of nickel and tin.

18. The contact/rotor assembly of claim 17, wherein the alloy includes approximately 7.0 per cent to 8.0 per cent nickel and approximately 4.5 per cent to 5.5 per cent tin.

19. The contact/rotor assembly of claim 12, wherein the first and second arrays of wire are formed of precious metal alloy wires.

20. The contact/rotor assembly of claim 19, wherein the precious metal alloy includes palladium, platinum, gold, and silver.

* * * * *